US008590584B2

(12) United States Patent
Marmer

(10) Patent No.: US 8,590,584 B2
(45) **Date of Patent: *Nov. 26, 2013**

(54) FLAMING WALLET AND/OR METHOD OF MAKING THE SAME

(75) Inventor: Howie Marmer, Atlanta, GA (US)

(73) Assignee: Invisible Intelligence Incorporated, Atlanta, GA (US)

( * ) Notice: Subject to any disclaimer, the term of this patent is extended or adjusted under 35 U.S.C. 154(b) by 721 days.

This patent is subject to a terminal disclaimer.

(21) Appl. No.: 12/662,169

(22) Filed: Apr. 2, 2010

(65) Prior Publication Data

US 2010/0292017 A1 Nov. 18, 2010

Related U.S. Application Data

(63) Continuation-in-part of application No. 12/232,769, filed on Sep. 24, 2008, now Pat. No. 7,712,496.

(51) Int. Cl.
*E05G 1/00* (2006.01)

(52) U.S. Cl.
USPC ..... 150/132; 472/65; 472/66; 431/125; 206/86; 206/90; 206/256

(58) Field of Classification Search
USPC ..... 150/132; 472/65, 66; 431/125; 206/90, 206/256, 86
See application file for complete search history.

(56) References Cited

U.S. PATENT DOCUMENTS 1,933,115 A * 10/1933 Jacobsen ..... 150/143
2,693,213 A * 11/1954 Marcus ..... 150/132
3,190,513 A * 6/1965 Wheeler ..... 224/683
5,617,799 A 4/1997 Kaczorowski
7,607,463 B2 * 10/2009 Huber ..... 150/135
7,712,496 B2 * 5/2010 Marmer ..... 150/132
2007/0295431 A1 12/2007 Mullen
2009/0114320 A1 5/2009 Flood

OTHER PUBLICATIONS

Flame Wallet Instruction, Jun. 6, 2009, screen capture of youtube video http://www.youtube.com/watch?v=IO1WRi0yGTs.*
Flamewallet.com screen capture of website showing a flaming wallet, dated Oct. 9, 2012.*
Flame Wallet Instruction, Aug. 6, 2010, screen capture of youtube video http://www.youtube.com/watch?v=oLP_YEhHhZQ.*

* cited by examiner

*Primary Examiner* — Tri Mai
(74) *Attorney, Agent, or Firm* — Nixon & Vanderhye PC

(57) ABSTRACT

Certain example embodiments relate to flaming wallets, and methods of making the same, with such flaming wallets typically being used for magic tricks, illusions, jokes, and/or general fun. In certain example embodiments, a flame mechanism may be substantially completely concealed by "fake money." The flame mechanism of certain example embodiments may include an igniter that produces a spark for causing flammable material applied to flame retardant material to combust, with the flame retardant material being inserted into respective recesses of one or more flame retardant material holders located between the inner surface of the flaming wallet and the rear surface of the fake money. In certain example embodiments, a magnet mechanism may facilitate the closing of the wallet and/or the extinguishing of the flames produced by the flaming wallet. Advantageously, the flaming wallet of certain example embodiments does not necessarily require hidden compartments or areas, or sleight of hand.

20 Claims, 6 Drawing Sheets

FLAMING WALLET AND/OR METHOD OF MAKING THE SAME

CROSS-REFERENCE TO RELATED APPLICATION

This application is a continuation-in-part (CIP) of application Ser. No. 12/232,769, filed on Sep. 24, 2008, now U.S. Pat. No. 7,712,496 the entire contents of which are hereby incorporated herein by reference.

FIELD OF THE INVENTION

Certain example embodiments of this invention relate to wallets that may be used for magic tricks, illusions, jokes, and/or general fun, and/or methods of making the same. More particularly, certain example embodiments relate to flaming wallets, and methods of making the same. In certain example embodiments, a flame mechanism may be substantially completely concealed by "fake money." The flame mechanism of certain example embodiments may include an igniter that produces a spark suitable for causing flammable material (e.g., lighter fluid) pre-applied to flame retardant material to combust, with the flame retardant material being inserted into respective recesses of one or more flame retardant material holders located between the inner surface of the flaming wallet and the rear surface of the fake money. In certain example embodiments, a magnet mechanism may facilitate the closing of the wallet and/or the extinguishing of the flames produced by the flame mechanism of the flaming wallet.

BACKGROUND AND SUMMARY OF EXAMPLE EMBODIMENTS OF THE INVENTION

The desire to be entertained is an integral part of the human condition. It is perhaps not that surprising, then, that jokes, gags, goofs, and other forms of general merriment have spurred an entire industry of comics, comedians, and entertainers in general. Furthermore, such general amusement may be yet further enhanced, when entertainers introduce senses of awe, amazement, and/or wonderment through the inclusion of magic tricks, illusions, or otherwise "mysterious" elements, into their routines. The combined reaction can be appreciated at birthday parties for children, special shows for persons of a wide range of ages and sensibilities, special events such as catered dinners or award ceremonies, and/or even for the occasional dose of jovial mischief at a place as ordinarily mundane as a gas station or grocery store.

Various devices or props have developed over the years to facilitate the making of merriment. For example, everyone is familiar with magicians using magic wands and saying "abracadabra" or pulling rabbits out of hats. A more recent device that has come into existence is the so-called flaming wallet. Flaming wallets generally look, for the most part, like ordinary wallets to the untrained observer. However, when "activated," flames may erupt "from" the flaming wallet. Taking an ordinary, everyday item like a wallet and making it do something shocking and unexpected—like temporarily bursting into flames—has been found to capture a sense of amusement and wonderment. Accordingly, a number of flaming wallets have been developed recently to aid merrymakers in their quest to spread amusement and jollity.

Unfortunately, however, many conventional flaming wallets suffer from serious disadvantages. For example, many conventional flaming wallets require the use of sleight of hand to complete the illusion. This typical requirement makes flaming wallets too complicated and/or difficult to use for many people. Indeed, sleight of hand often is required to conceal the flame-producing mechanism from observers' views, create the flame, extinguish the flame, show money in the wallet, etc. Thus, if the sleight of hand is not complete and precise, the trick is easily ruined and the "secrets" of the flaming wallet are revealed.

One known type of flaming wallet is the "Z-fold" type wallet. A typical Z-fold wallet has a first side that produces flames and a second side that shows and/or includes real or fake money. In operation, the second side is shown to observers, the wallet is flipped and the flame-producing mechanism is actuated, the flames are extinguished, and the wallet is once again flipped to show the second side to the observers. The various flips and actuation of the flame-producing mechanism is intended to be kept secret from target observers. Unfortunately, however, as can be appreciated, the flipping required is often noticeable by untrained observers and is difficult to perform. Thus, Z-fold type wallets are disadvantageous in operation.

Z-fold type wallets also typically are disadvantageous structurally. Indeed, typical Z-fold wallets have flame-retardant pads glued directly on the wallet (e.g., directly on leather surfaces thereof). The glue that holds the flame retardant pads to the wallet ultimately melts over time and exposure to the heat produced by the flame. Additionally, the pads tend to melt through the body of the wallet, rendering the wallet inoperable and also creating a fire hazard. Fuel also tends to soak through the pads and onto the wallet, thereby further damaging the wallet. The melting glue also produces an undesirable smell, even before the wallet is rendered useless and/or unsafe.

Another type of flaming wallet may be termed a "wallet and a half." This arrangement may be thought of as a book with one page. An envelope portion includes real and/or fake money. In addition to the above-described drawbacks of Z-fold wallets, "wallet and a half" type wallets require the user to get into an envelope portion to show the real and/or fake money. Accordingly, the illusion is not as good as it otherwise could be, as the flames are not seen to be close to the money.

Thus, it will be appreciated that there is a need in the art for improved flaming wallets, and/or methods of making the same.

In certain example embodiments of this invention, a wallet is provided. A representation of a bank note is located inside the wallet such that the representation of the bank note is visible when the wallet is open. At least one flame-retardant pad is provided. At least one holder is provided. Each said holder includes a recess for accommodating one said flame retardant pad. The at least one holder is located on a back surface of the representation of the bank note, with the back surface facing towards the wallet. An igniter is at least partially concealed by the representation of the bank note. The igniter is arranged so as to cause a spark proximate to the at least one flame-retardant pad. The spark is sufficiently close to the at least one flame-retardant pad to cause flammable material provided thereto to catch fire. A magnetic closing mechanism is provided to the at least one holder and/or the wallet for facilitating the closing of the wallet after the flammable material has caught fire and/or to help extinguish any flames.

In certain example embodiments, a flaming wallet is provided. A fake bill is located inside the wallet such that the fake bill is discernable to a viewer when the wallet is opened. At least one pad comprising flame-retardant material is provided. A metal-inclusive holder for each said pad is provided. Each said holder includes a recess for accommodating the corresponding pad and being substantially concealed from view by the viewer by the fake bill. An igniter is substantially concealed by the fake bill. The igniter is arranged so as to cause a spark proximate to the at least one flame-retardant pad. A magnetic closing mechanism is provided to the wallet to facilitate the closing of the wallet and/or to help extinguish any flames produced by the flaming wallet.

Methods of making the above-described wallets also are provided herein.

The features, aspects, advantages, and example embodiments described herein may be combined to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION OF EXAMPLE EMBODIMENTS OF THE INVENTION

Figure 1:
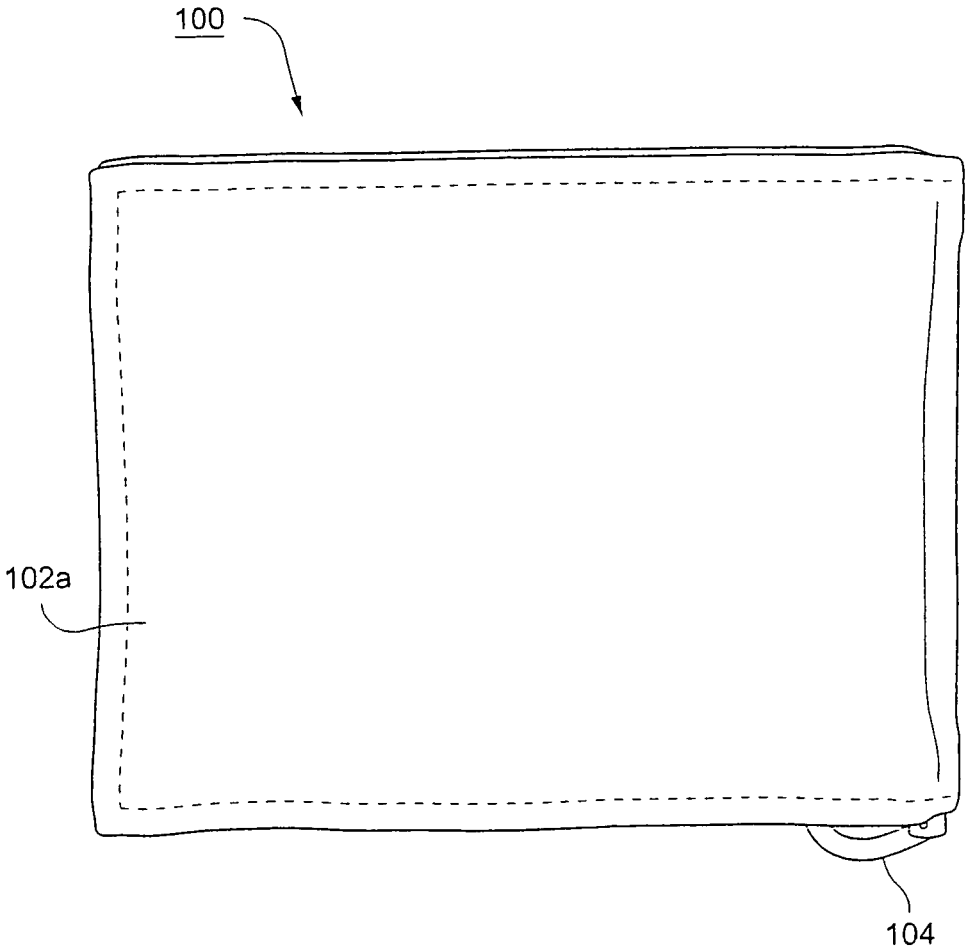
FIG. 1 is a side view of a closed flaming wallet in accordance with an example embodiment.

In certain example embodiments, flaming wallets, and/or methods of making the same, are provided, with such flaming wallets typically being used for magic tricks, illusions, jokes, and/or general fun. In certain example embodiments, a flame mechanism may be substantially completely concealed by "fake money." The flame mechanism of certain example embodiments may include an igniter that produces a spark suitable for causing flammable material (e.g., lighter fluid) pre-applied to flame retardant material to combust, with the flame retardant material being inserted into respective recesses of one or more flame retardant material holders located between the inner surface of the flaming wallet and the rear surface of the fake money. In certain example embodiments, a magnet mechanism may facilitate the closing of the wallet and/or the extinguishing of the flames produced by the flame mechanism of the flaming wallet.

Referring now more particularly to the accompanying drawings in which like reference numerals indicate like parts/layers throughout the several views.

FIG. 1 is a side view of a closed flaming wallet 100 in accordance with an example embodiment. The flaming wallet 100 has an exterior main wallet body 102*a*. The exterior main wallet body 102*a* may be made of any suitable material such as, for example, leather, vinyl, nylon, or other suitable material. A hinged member 104 (e.g., of metal or plastic) protrudes downwardly from the main wallet body 102*a* in embodiments where such an optional hinged member 104 is included. In other words, the hinged member 104 is optional and is provided as a decorative element, e.g., of the type sometimes found in or on wallets, billfolds, and/or the like.

Figure 2:
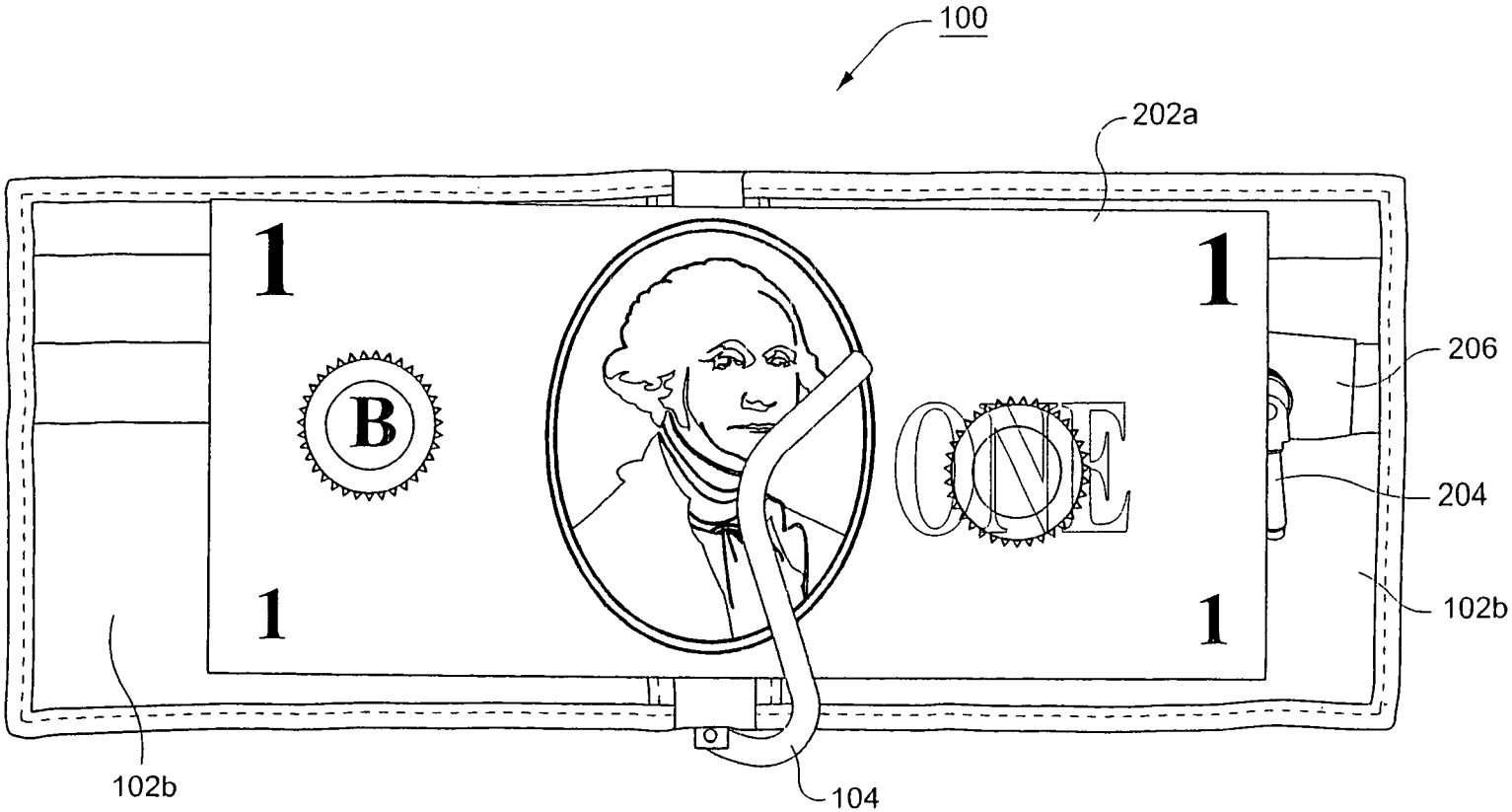
FIG. 2 is a view of the interior of a flaming wallet in accordance with an example embodiment.

FIG. 2 is a view of the interior of a flaming wallet 100 in accordance with an example embodiment. In particular, the flaming wallet 100 includes a main interior wallet body 102*b*, which may include slots for credit cards, a pouch for coins, and/or other features commonly found in wallets and/or billfolds. A reproduction of a bill (also sometimes simply referred to as a "fake bill") 202 is provided in the flaming wallet 100. The face of the fake bill 202*a* is discernable to the casual observer and appears as if it were a real bill. Although a $1 bill is shown in FIG. 2, it will be appreciated that a bill or banknote of any denomination and/or of any country may be used in connection with certain example embodiments. Optionally, additional fake bills 202 may be provided inside of the flaming wallet 100. One of the sides of the fake bills 202 may be removedly attached (e.g., by the magnet closing mechanism described in greater detail below in connection with FIG. 4), whereas the other side may be free to move about, in certain example embodiments. The fake bills 202 may help to protect any real money and/or other items (e.g., credit cards, drivers licenses, etc.) inserted into the wallet. That is, in certain example embodiments, additional "real money" may be provided in the flaming wallet 100 "over" the face of the fake bill 202*a* such that the fake bill 202 shields the "real money" from the flames, as explained in greater detail below.

The hinged member 104 extends over the face of the fake bill 202*a*, just as if the fake bill 202*a* were a real bill. The hinged member 104 helps hold any real money inserted into the wallet 100 substantially in place. The face of the fake bill 202*a* helps conceal an igniter 204 in whole, substantially, or in part. Similarly, the face of the fake bill 202*a* helps conceal the backing member 206 in whole or in part. The stem of the igniter 204 may be inserted into a hole cut in the body of the flaming wallet 100 such that it remains substantially in place when a user attempts to produce a spark in certain example embodiments. The backing member 206 may be inserted into one of the folds configured to receive credit cards or may be otherwise attached to the flaming wallet 100.

Any suitable igniter may be used in connection with the example embodiments described herein. For example, a "childproof" Flami lighter may be used in example embodiments where it is desirable to reduce the likelihood of a person inadvertently injuring himself or herself or another person. A Zippo lighter may be used in example embodiments where it is desirable to have a larger wheel (e.g., to facilitate the lighting of the material). Other commercially available lighters (such as, for example, those provided by the Spanish company Flamagas) also may be used in connection with certain example embodiments.

Figure 3:
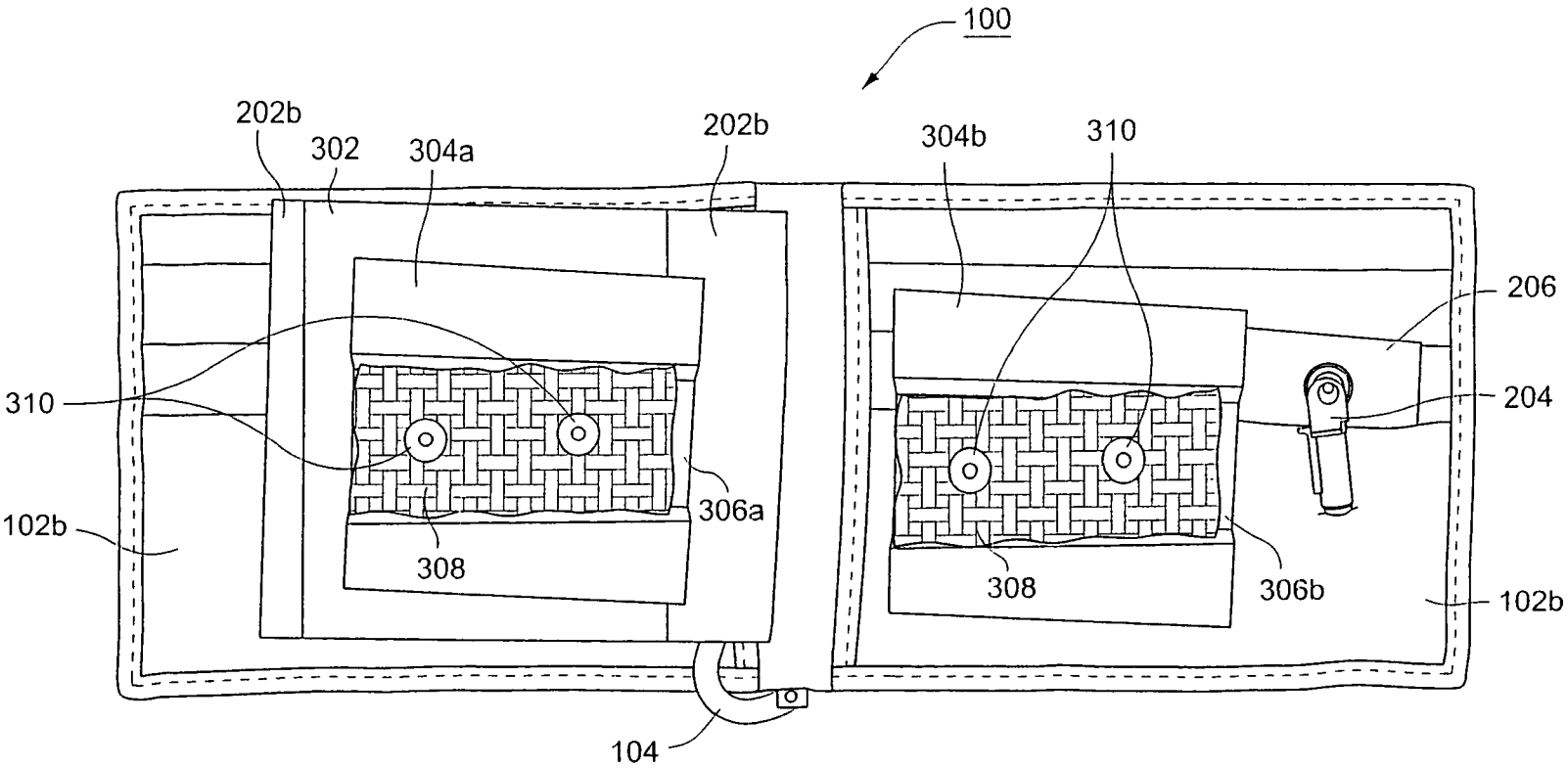
FIG. 3 is a view of the inner flame mechanism of the flaming wallet shown in FIG. 2, in accordance with an example embodiment.

FIG. 3 is a view of the inner flame mechanism of the flaming wallet shown in FIG. 2, in accordance with an example embodiment. An insulating material 302 is provided on the back of fake bill 202*b* such that it covers some, most, or all of the back of the fake bill 202*b*. Providing the insulating material 302 helps reduce the amount of heat from the flames that are produced from reaching any real bills or the user's fingers, which may be inside of the face of the fake bill 202*a*. It also may provide some flame-retarding functions in certain example embodiments. Additionally, or in the alternative, the fake bill 202 may comprise a fake bill face 202*a* separate from a fake bill backing 202*b*, with the fake bill face 202*a* and the fake bill backing 202*b* being separated by insulating material (e.g., a heat insulating material). If the bills are below the flash line or lower than the fake bill and closer to the hinge stem bill holder, the bills sometimes may be less likely combust. Certain example embodiments may be designed so that the bills are ignitable if desired, so that they may appear to be smoldering when the fire is extinguished. In certain implementations, sparks may emanate from the bills when smoldering or lit bills are flicked with the fingers.

In certain example embodiments, the insulating material 302 may comprise one or more layers of a flame retardant, heat resistant, and/or other heat shielding material. For example, in certain example embodiments, the insulating material 302 may comprise one or more layers of silicone. The insulating material 302 may help reduce the wear on the fake bill over time, which otherwise could lead to tearing from the opening/closing action, exposure to heat and/or flame, etc. When a silicone layer is used as a layer in the insulating material 302, the resiliency and/or "springiness" of the material may help serve as a spring itself, splaying and/or otherwise forcing any real bills outwardly into a fan-like shape. It has been discovered that this is yet a further performance-enhancing feature of certain example embodiments. Of course, other materials may be used in place of or in addition to the silicone. The silicone may be connected to the fake bill in any suitable way. For example, the silicone may be sandwiched between two pieces of metal that may, in turn, be connected to the holder 304*a* (described in greater detail below), or the holder 304*a* may serve as one piece of metal and another piece of metal may be provided on a major surface opposite the holder 304*a*. As another alternate or additional example, a thread or mesh (e.g., of Kevlar or the like) may be used to sew the silicone to the wallet and/or fake bill. In certain example embodiments, these and/or other techniques may be combined for one or both sides of the fake bill. For instance, in certain example embodiments, silicone sandwiched between two pieces of metal may be used for the side proximate the flame, whereas a Kevlar thread or mesh may be used for the side more remote from the flame, or vice versa.

The inner flame mechanism shown in FIG. 3 comprises first and second flame retardant material holders 304*a*, 304*b*. The first and second flame retardant material holders 304*a*, 304*b* may be of or include metal, high-temperature plastic, or any other material that is not substantially damaged by the heat of flames. The first flame retardant material holder 304*a* may be connected to the fake bill 202 by any suitable means. For example, the FIG. 3 example embodiment shows grommets 310 securing the first flame retardant material holder 304*a* to the fake bill 202. The second flame retardant material holder 304*b* may be secured to the backing member 206 by a similar or different means. Thus, the FIG. 3 example embodiment shows grommets 310 securing the second flame retardant material holder 304*b* to the backing member 206 via grommets 310. As alluded to above, other securing means may be used including, for example, high temperature adhesives, bolts, and/or other any other suitable low profile securing means.

The first and second flame retardant material holders 304*a*, 304*b* include first and second recessions 306*a*, 306*b*, respectively. The first and second recessions 306*a*, 306*b*, in turn, are shaped and sized to accommodate pieces of flame retardant material 308 therein. The flame retardant material 308 may comprise any suitable material such as, for example, lamp wicking, materials used in flame-retardant curtains, and/or the like. The flame retardant material 308 may be exposed, e.g., slightly beyond the edges of the first and/or second recessions 306*a*, 306*b*, such that the flaming wallet 100 will appear to flicker a little because there is some oxygen and material left to combust at such exposed portions. For example, the flame retardant material 308 may be cut at an angle (e.g., a 45 degree or greater or lesser angle), extra material simply may protrude from the first and/or second recessions 306*a*, 306*b*, etc.

The flame retardant material 308 may be at least partially wetted (and occasionally re-wetted) with a flammable material (such as, for example, liter fluid) so that a spark from the igniter 204 creates a fire that is spread along, but is substantially confined to, the area defined by the flame retardant material 308. The igniter 204 may be angled towards the flame retardant material 308 (away from the closer edge of the flaming wallet 100 and towards the hinged arm 104), thereby making it more likely that a spark therefrom will cause a controlled fire and also making it easier when a safety lighter (e.g., of the type that typically requires a wheel to be moved down and to the side to be struck) is implemented. The exact angling of the igniter 204 may vary, e.g., in dependence on the user's finger, skill in operating flaming wallet 100, the visibility of the igniter 204, etc. The flame retardant material holder 304*b* may be bent somewhat or otherwise positioned such that it is substantially flush with the igniter 204 (and/or the flint wheel thereof), thereby also increasing the likelihood that a spark will cause a flame proximate to the flame retardant material 308. The flame retardant material holder 304*b* also may be inserted into one of the folds configured to receive credit cards (e.g., as shown perhaps best in FIG. 4) or may be otherwise attached to the flaming wallet 100. In general, the flame retardant materials may be thought of as pads of flame retardant material.

Optionally, the first and second flame retardant material holders 304*a*, 304*b* may be located in close relative proximity to one another and further may be connected by one or more small hinges. The hinge(s) may be made from the same or different material as the first and/or second flame retardant material holders 304*a*, 304*b*. For example, in certain example embodiments, a single small brass hinge may be provided so as to connect the first and second flame retardant material holders 304*a*, 304*b* approximately in the vertical centers thereof. The one or more optional hinges may further facilitate the opening and/or closing of the flaming wallet 100. Furthermore, the one or more optional hinges may be used in connection with, or in place of, the hinged member 104.

Figure 4:
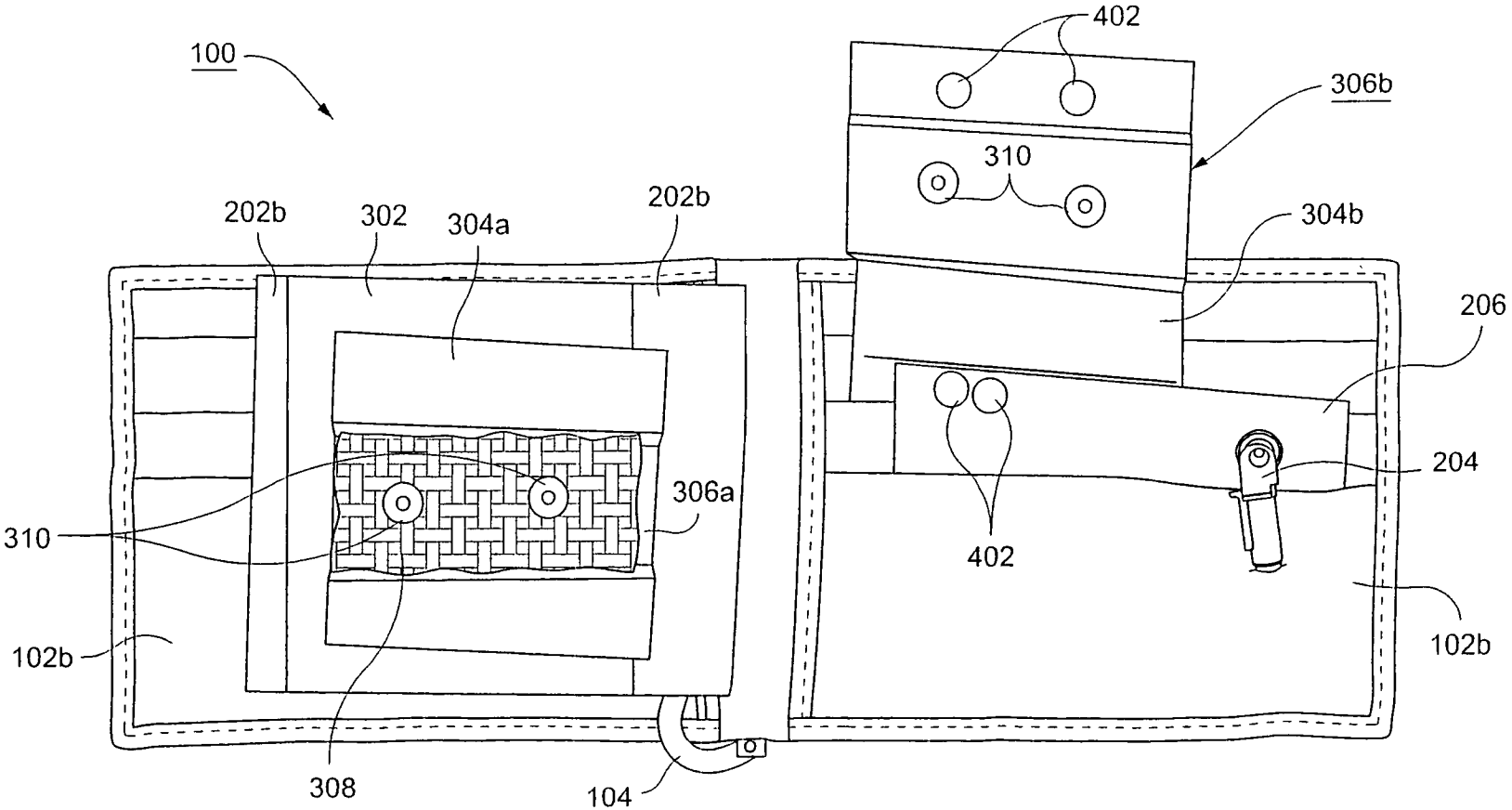
FIG. 4 is a view of the inner magnet closing mechanism of the flaming wallet shown in FIG. 2, in accordance with an example embodiment.

FIG. 4 is a view of the inner magnet closing mechanism of the flaming wallet shown in FIG. 2, in accordance with an example embodiment. FIG. 4 is similar to FIG. 3, except that the inner magnet closing mechanism of the flaming wallet 100 is shown. That is, the back side of the flame retardant material holder 304*b*, or the inner surface of a folded-over flame retardant material holder 304*b* (e.g., of the type shown in FIG. 4) is shown. At least one small magnet 402 is connected to the flame retardant material holder 304*b*. If the flame retardant material holder 304*b* itself is metal, an additional connection means (such as an adhesive, bolt mechanism, etc.) need not be used. Additionally, or in the alternative, at least one small magnet 402 also is provided to the backing member 206. As above, if the backing member 206 itself is metal, an additional connection means (such as an adhesive, bolt mechanism, etc.) need not be used. Although two magnets 402 are shown on each of the flame retardant material holder 304*b* and the backing member 206, it will be appreciated that more or fewer magnets may be used in the same, similar, or different positions. Of course, it will be appreciated that the various connection means may be varied and/or used in any suitable combination and/or sub-combination such that the magnet closing mechanism functions as desired.

The magnet(s) 402 help the user close the flaming wallet 100 when flames are active. For example, the magnet(s) 402 may be positioned such that they encourage the flame retardant material holder 304*a* to magnetically spring closed when it is a predetermined distance from the magnet(s) 402, thus helping to keep the user's fingers away from the fire and making it easier for the flaming wallet 100 to close, in general. Indeed, the magnet(s) 402 helps extinguish the flames by reducing the amount of oxygen for the flames to burn proximate to the flame retardant material 308 (e.g., since the two strips of flame retardant material 308 are made to come together). This may be accomplished in certain example embodiments by providing a flame retardant material holder 304*a* made of metal and/or by providing one or more appropriate polar magnets to the flame retardant material holder 304*a* to engage with the magnet(s) 402.

It will be appreciated from the above-description and the examples shown visually in FIGS. 1-4 that the flame mechanism of the flaming wallet 100 of certain example embodiments is built into the wallet itself and is substantially concealed by the money itself. It also will be appreciated that the holders 304*a*, 304*b* help protect the body of the wallet 100 from damage caused by the flames and/or the flammable material applied to the pads.

Figure 5:
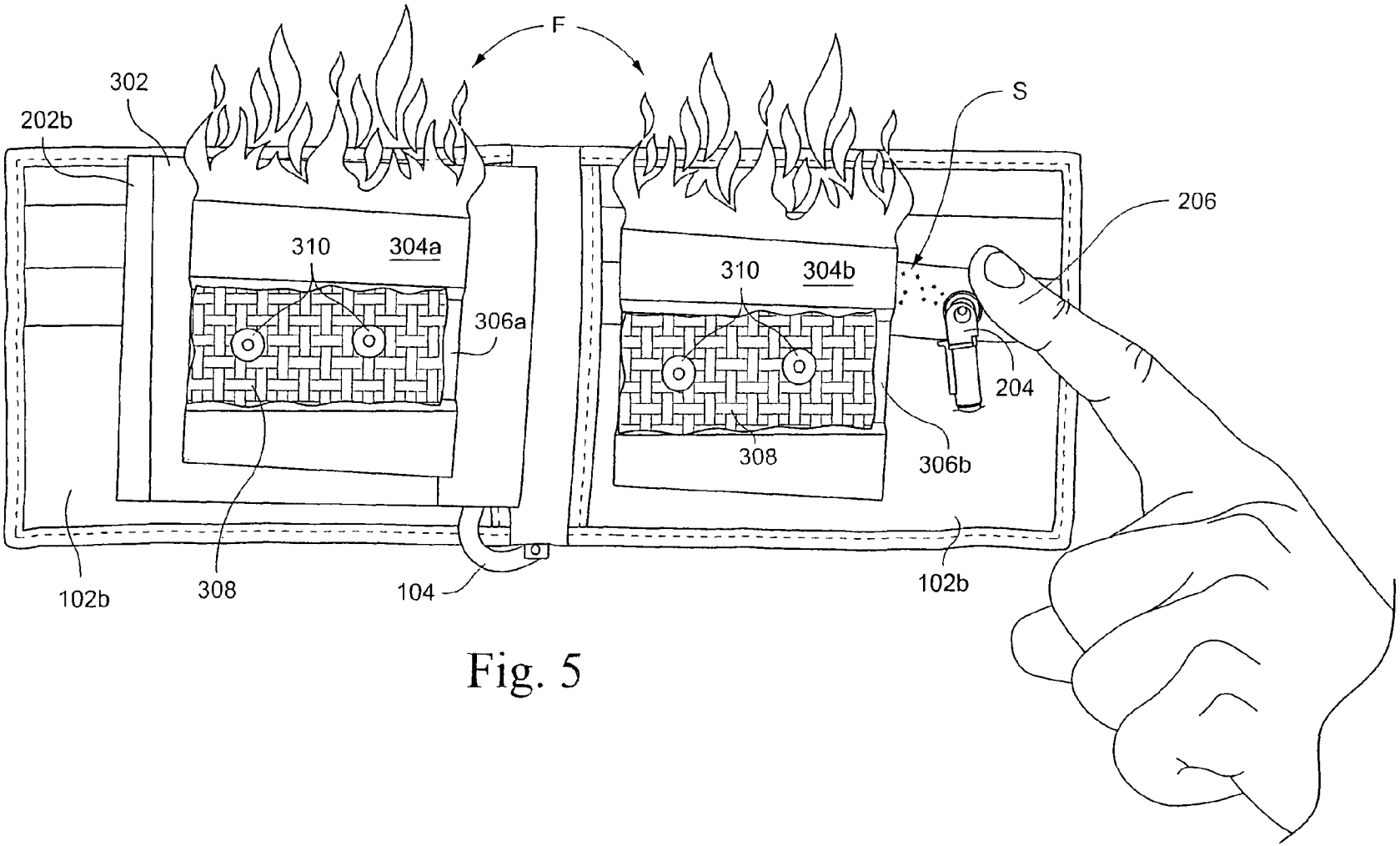
FIG. 5 is a view of flames escaping from a flaming wallet in accordance with an example embodiment.

FIG. 5 is a view of flames F escaping from a flaming wallet 100 in accordance with an example embodiment. Typically, a flammable liquid such as lighter fluid will be applied to the flame retardant material 308, prior to the illusion or trick being performed. The flaming wallet 100 may be opened to reveal the fake bill 102 and/or any real money inserted therein. A user's finger (typically an index finger or thumb) may use the igniter 204 when the flaming wallet 100 is closed, opened to reveal the fake money 102, opened to expose the flame retardant material 310, or is in the process of being opened to one of these positions, etc. The spark S from the igniter 204 will cause the flammable liquid applied to the flame retardant material 310 to catch fire. Flames F will appear to leap out of the flaming wallet 100 (e.g., when it is fully opened). To complete the illusion or trick, the flaming wallet 100 is closed, and the magnet(s) 402 facilitate the closing of the flaming wallet 100 as well as the extinguishing of the flames F. The flaming wallet 100 may be reopened to show the fake and/or real money still intact after the flames are extinguished. Optionally, the real or fake money may be positioned slightly to the side or top or bottom such that it is slightly singed, thus enhancing the quality of the illusion or trick. Jokes may be made, before, during, and/or after the illusion or trick, along the lines of, for example, "This money is burning a hole in my pocket," "I stole this wallet; it's hot," etc.

Advantageously, the flaming wallet of certain example embodiments reduces and sometimes even eliminates the need for the sleight of hand required for some conventional flaming wallets. For example, the flaming wallet of certain example embodiments does not necessarily need to be flipped, turned, or otherwise manipulated in a way that is unlike the normal way a wallet would be used. Similarly, the flaming wallet of certain example embodiments does not necessarily require the use of hidden compartments or areas; rather, as noted above, the flame mechanism is built into the wallet itself and is substantially concealed by the money itself. The first and second flame retardant material holders 304*a*, 304*b*, advantageously help protect the body of the flaming wallet from damage by the flames and/or fuel that might otherwise seep through the flame retardant material and onto the wallet. Safety also is improved by keeping the flame and/or fuel away from the body of the flaming wallet itself.

It will be appreciated that alternative or additional features may be provided to help facilitate the functioning of different embodiments of this invention. For instance, certain example embodiments may include a spring hinge or other suitable mechanism. A carefully placed spring hinge may help keep the pads aligned when the wallet closes. This arrangement is advantageous from performance and functionality perspectives, as it may enable the wallet to better stay open when one side of the wallet is closed, while the rapid springing action helps cause the first and second flame retardant material holders 304*a*, 304*b* to rapidly close. The rapid closing, in turn, has been found to cause a desirable visual effect, whereby the flames "morph" into the bills. The rapid springing action also is advantageous from a safety perspective. That is, if the wallet is dropped while flames are emanating from the wallet, the tension on the spring hinge tends to force the wallet closed, extinguishing the flames between the flame retardant material 308. Still further, the spring hinge helps form a tight connection between the two inner sides of the wallet, keeping the flame retardant material 308. This advantageously has been found to reduce fuel evaporation, even through periods of non-use. Furthermore, in example embodiments where glue is avoided, it is possible to provide room for an increased amount of fuel, e.g., by virtue of thicker pads.

Figure 6:
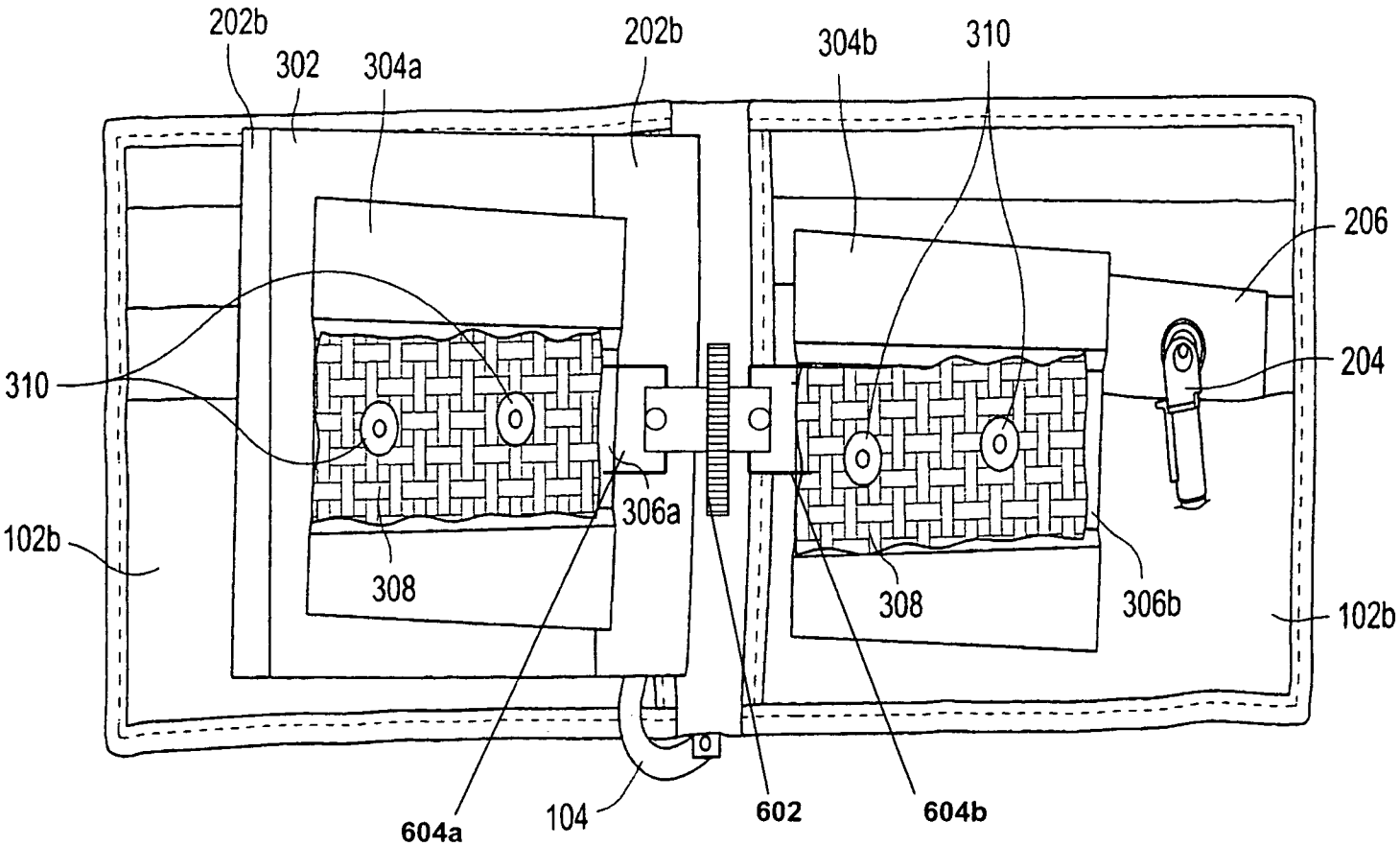
FIG. 6 is a view of the inner flame mechanism of a flaming wallet that incorporates a spring hinge, in accordance with an example embodiment.

FIG. 6 is a view of the inner flame mechanism of a flaming wallet that incorporates a spring hinge 602, in accordance with an example embodiment. The spring hinge 602 is structurally robust in that it can withstand multiple openings and closings and possible flame exposure. As shown in the FIG. 6 example embodiment, the spring hinge 602 may be located proximate to the fold of the wallet and/or roughly centered between the first and second flame retardant material holders 304*a*, 304*b*. In certain example embodiments, the spring hinge may be small in size, e.g., so that it is easily concealed and operated. For example, in certain instances, the spring hinge 602 may be smaller in size than either or both of the first and second flame retardant material holders 304*a*, 304*b* and/or the flame retardant material 308 (e.g., about 0.25" in height). The spring hinge 602 may be held in position by any suitable mechanism and may cause the "inner sides" to close by suitable connection thereto. In the FIG. 6 example, first and second tabs 604*a*, 604*b* are provided to the first and second flame retardant material holders 304*a*, 304*b*, respectively. The spring hinge 602 is then connected to these tabs, e.g., using rivets or the like. The spring hinge may be seated properly by adjusting the metal tabs (e.g., sizing them, bending them, and/or differently shaping them). In certain example embodiments, the spring hinge 602 may therefore "float" between the first and second flame retardant material holders 304*a*, 304*b*, whereas the spring hinge 602 may be more securely and/or directly fixed to the wallet in different example embodiments. Thus, in certain example embodiments, a spring hinge may be located proximate to a fold in the wallet and coupled to each said metal-inclusive holder, with the spring hinge being biased so as to cause inner portions of the wallet to remain closed. This arrangement may be included in place of, or in addition to, the magnet structure described above. In such embodiments, the illusion or effect may be completed by closing the wallet or keeping the wallet open while releasing the left side, allowing the spring hinge system to close the area and extinguish the flames.

In certain example embodiments, the igniter may be attached to the holder 304*b* with an acid core solder. A tab may be bent at an angle (e.g., a 90 degree angle) towards the bottom of the holder 304*b*, to allow a brass flint striker to be in close proximity to the pad(s). A more durable striker device is sometimes desirable in terms of exposure to flames. It has been discovered that, in certain example implementations, when changing the flint in the striker mechanism as the brass screw is loosened and removed, there may be a small spring that keeps the flint pressed up against the flint wheel such that, when changing the flint, the spring may fall out and become caught by the magnet, thereby keeping the spring from being lost during flint replacement. In certain example embodiments, extra flints may be stored on the sides of the magnet(s) themselves, and there may even be room for a tiny screwdriver to be stored in this fashion as well.

It will be appreciated that the example flaming wallets described herein have been described essentially as being "right-handed" flaming wallets. However, the present invention is not so limited. For example, the igniter may be placed on the left side of an open wallet in certain example embodiments. In still other example embodiments, two separate igniters may be provided, with one igniter being provided to each side of the flaming wallet. Furthermore, although two flame retardant pads are shown in certain example embodiments, the present invention is not limited to the illustrated number, placement, and relative sizes of pads. That is, in certain example embodiments, more or fewer pads may be provided in the same or different places, and the pads may be the same or different sizes relative to one another. Also, it will be appreciated that the example embodiments herein may be extended to a wide variety of different style wallets. For example, although bi-fold wallets are described, the example embodiments described herein also may be applied to tri-fold wallets, bill folds, and/or other style products.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A wallet, comprising:

a representation of a bank note located inside the wallet such that the representation of the bank note is visible when the wallet is open;

at least one flame-retardant pad;

at least one holder, each said holder including a recess for accommodating one said flame retardant pad, the at least one holder being located on a back surface of the representation of the bank note, the back surface facing towards the wallet;

an igniter at least partially concealed by the representation of the bank note, the igniter being arranged so as to cause a spark proximate to the at least one flame-retardant pad, the spark being sufficiently close to the at least one flame-retardant pad to cause flammable material provided thereto to catch fire;

a spring hinge located proximate to a fold in the wallet and coupled to each said metal-inclusive holder, the spring hinge being biased so as to cause inner portions of the wallet to remain closed; and a hinged member located in or proximate to the fold in the wallet, a portion of the hinged member extending over a face of the representation of the bank note.

2. The wallet of claim 1, further comprising a magnetic closing mechanism provided to the at least one holder and/or the wallet for facilitating the closing of the wallet after the flammable material has caught fire and/or to help extinguish any flames.

3. The wallet of claim 1, wherein the igniter is angled towards the at least one pad.

4. The wallet of claim 1, wherein the representation of the bank note comprises first and second image layers separated by a layer of insulating material.

5. The wallet of claim 4, wherein the insulating material comprises silicone.

6. The wallet of claim 1, further comprising first and second holders, the first and second holders respectively provided to opposite sides of the representation of the bank note.

7. The wallet of claim 2, wherein the magnetic closing mechanism comprises a metal backing plate provided to the wallet and at least one magnet provided on the metal backing plate such that magnet attracts the at least one holder.

8. The wallet of claim 1, wherein the at least one flame-retardant pad is at least partially exposed.

9. The wallet of claim 1, wherein the wallet is configured for use substantially free from sleight of hand.

10. The wallet of claim 1, wherein the wallet includes a plurality of slots configured to receive credit cards.

11. A method of making a flaming wallet, the method comprising:

providing a bi-fold wallet;

providing a representation of a bank note located inside the wallet such that the representation of the bank note is visible when the wallet is open, the bank note being folded proximate to a fold in the wallet;

providing a decorative hinged arm in or proximate to a fold in the wallet;

providing at least one holder, each said holder including a recess for accommodating a respective flame retardant pad, the at least one holder being located on a back surface of the representation of the bank note, the back surface facing towards the wallet;

arranging an igniter so that it is at least partially concealed by the representation of the bank note, and so as to cause a spark proximate to the at least one flame-retardant pad, when actuated, the spark being sufficiently close to the at least one flame-retardant pad to cause flammable material provided thereto to catch fire; and locating a spring hinge proximate to the fold in the wallet and coupling the spring hinge to each said metal-inclusive holder, the spring hinge being biased so as to cause inner portions of the wallet to close and remain closed unless opened and held open.

12. The method of claim 11, further comprising providing a magnetic closing mechanism to the at least one holder and/or the wallet for facilitating the closing of the wallet after the flammable material has caught fire and/or to help extinguish any flames.

13. The method of claim 11, further comprising angling the igniter towards the at least one pad.

14. The method of claim 11, further comprising forming the representation of the bank note by sandwiching a layer of insulating material with first and second image layers.

15. The method of claim 14, wherein the insulating material comprises silicone.

16. The method of claim 11, further comprising providing first and second holders, the first and second holders respectively provided to opposite sides of the representation of the bank note.

17. The method of claim 12, wherein the magnetic closing mechanism comprises a metal backing plate provided to the wallet and at least one magnet provided on the metal backing plate such that magnet attracts the at least one holder.

18. The method of claim 11, further comprising arranging the at least one flame-retardant pad so that it is at least partially exposed.

19. The method of claim 11, wherein the wallet is configured for use substantially free from sleight of hand.

20. A flaming wallet, comprising:

a fake bill located inside the wallet such that the fake bill is discernable to a viewer when the wallet is opened;

at least one pad comprising flame-retardant material;

a metal-inclusive holder for each said pad, each said holder including a recess for accommodating the corresponding pad and being substantially concealed from view by the viewer by the fake bill;

an igniter substantially concealed by the fake bill, the igniter being arranged so as to cause a spark proximate to the at least one flame-retardant pad;

a spring hinge located proximate to a fold in the wallet and coupled to inner areas of the wallet, the spring hinge being biased so as to cause inner portions of the wallet to close and remain closed unless opened and held open; and a hinged member located in or proximate to the fold in the wallet, a portion of the hinged member extending over a face of the representation of the bank note.

* * * * *